United States Patent [19]

Birnstiel

[11] 4,142,468

[45] Mar. 6, 1979

[54] ELEVATED RAIL TRANSIT GUIDEWAY WITH NOISE ATTENUATORS

[76] Inventor: Charles Birnstiel, 68-15 Fleet St., Forest Hills, N.Y. 11375

[21] Appl. No.: 785,517

[22] Filed: Apr. 7, 1977

Related U.S. Application Data

[63] Continuation-in-part of Ser. No. 678,669, Apr. 23, 1976, abandoned.

[51] Int. Cl.[2] ..... E01B 19/00

[52] U.S. Cl. ..... 104/124; 14/1; 104/1 R; 181/210; 404/1

[58] Field of Search ..... 104/1 R, 118, 119, 124, 104/133, 120, 125; 105/141, 144, 452; 181/210, 284, 293; 404/1, 17; 14/1; 52/174, 732

[56] References Cited

U.S. PATENT DOCUMENTS

| | | | |
|---|---|---|---|
| 221,450 | 11/1879 | Dodson | 104/124 |
| 250,220 | 11/1881 | Dodson | 104/124 |
| 785,247 | 3/1905 | Wood | 104/124 |
| 937,338 | 10/1909 | Strauss | 104/124 |
| 2,225,186 | 12/1940 | Sorensen | 404/1 |
| 3,212,453 | 10/1965 | Lich | 104/124 |
| 3,540,068 | 11/1970 | Bouthors | 104/124 X |
| 3,561,364 | 2/1971 | Giraud | 104/120 |
| 3,772,993 | 11/1973 | Noble et al. | 104/1 R |
| 3,859,682 | 1/1975 | Sulkiewicz | 104/124 X |
| 4,037,541 | 7/1977 | Giessler et al. | 104/124 X |
| 4,050,538 | 9/1977 | Desenfant | 181/210 |

*Primary Examiner*—Frank E. Werner
*Assistant Examiner*—Randolph A. Reese
*Attorney, Agent, or Firm*—Auslander & Thomas

[57] ABSTRACT

An elevated dual-rail transit guideway in which the structural spanning members are shaped so as to serve also as baffles for suppressing the propagation of noise into the surroundings. The interior surface of the baffles may be treated with sound absorbing material to further improve their effectiveness.

6 Claims, 6 Drawing Figures

ELEVATED RAIL TRANSIT GUIDEWAY WITH NOISE ATTENUATORS

This application is a continuation in part of Ser. No. 678,669 filed Apr. 23, 1976 in Group 314 of the Patent and Trademark Office now abandoned.

Most extant elevated rail rapid transit systems were erected during the latter part of the nineteenth and the early part of the twentieth centuries. Built by private enterprise at minimal cost, they are not aesthetically appealing and were always noisy, although the present noise levels are undoubtedly higher than when the systems were originally placed into service because of degraded maintenance and operating practices. By far most mileage was constructed with the running rails mounted upon timber ties which rest directly on longitudinal steel girders or trusses (open deck construction). Most of the noise results from the action of the steel wheels on the steel rails. Vibrations from this source are transmitted to the steel elevated structure, being dampened only by the ties. The structure, comprised of many elastic elements of light mass, transmits the vibrations to the atmosphere. Other sources of noise are vehicle motors, gearing, compressors, and braking mechanisms. The major portion of such noise originates below the car floor level, yet the existing elevated structures have few components which can serve as baffles to impede propagation of noise into the surroundings.

The poor appearance of most elevated structures is due principally to the fact that they are usually open deck structures which are assembled from many exposed elements. The elevation of the top-of-rail is higher for open deck structures than would be necessary for other types, for the same underclearance. This requires that station platforms be at a higher level and the whole guideway system is more obtrusive.

From the standpoint of safety of personnel at ground level, the conventional open deck construction has disadvantages. Because of improper maintenance, falling track hardware and car parts have become common occurances. Also, the lack of a longitudinal guard barrier has resulted in cars falling to the ground on occasions of derailment.

The reduction of the adverse environmental effects of noise, visual intrusion, and danger to personnel at ground level is the overall objective of the improvement proposed herein. It consists of spanning members, supported at intervals by columns, whose cross section is such as to extend above the level of the top of rail and thereby serve also as baffles to impede the propagation of noise to the surrounding community. The detailed objectives and advantages of the invention will be evident from the following description and the accompanying drawings, in which.

Figure 1:
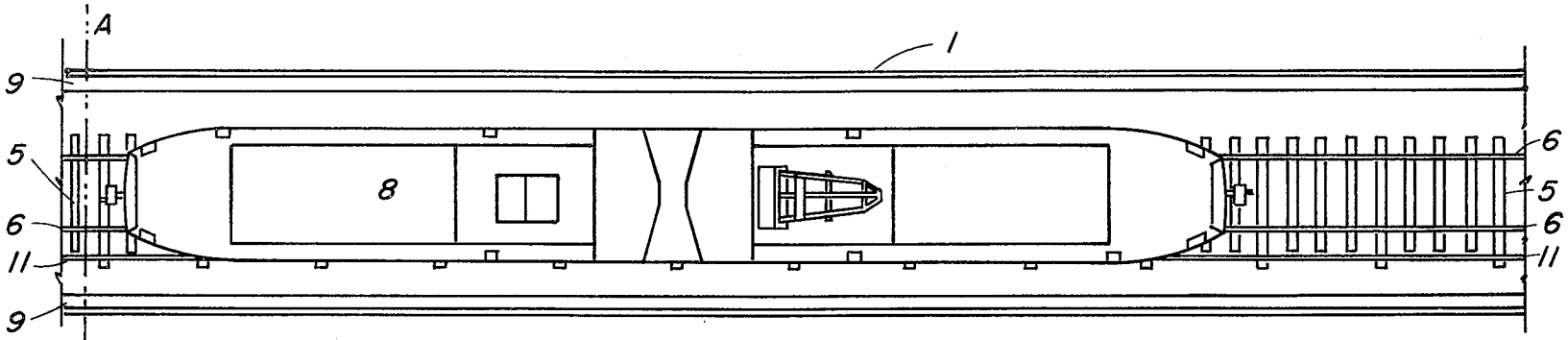
FIG. 1 is a partial top view of a rail transit vehicle and the elevated guideway with noise attenuators which embodies the invention.
Figure 2:
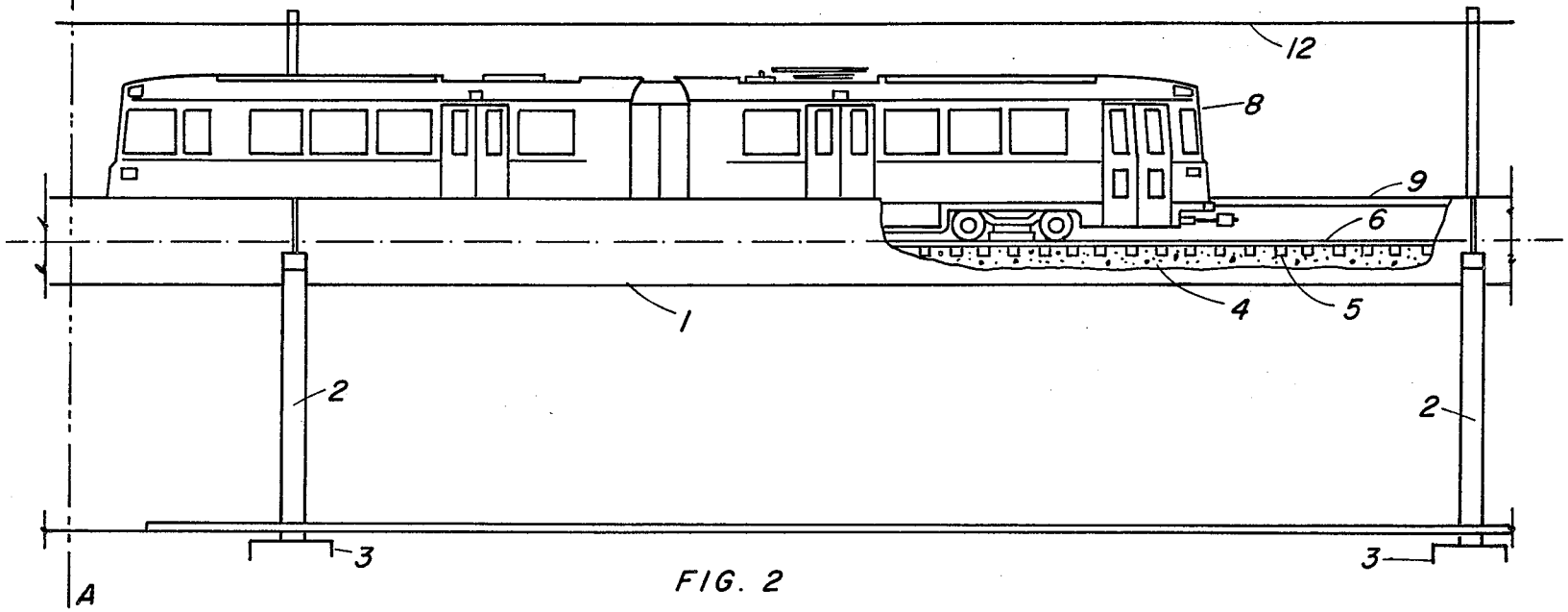
FIG. 2 is an elevational view corresponding to FIG. 1.

The figures depict the Standard Light Rail Vehicle and a single track guideway. However, the concept is suitable for multiple track guideways and for other rail vehicles. The components of the guideway will first be identified and their relationship illustrated, after which they will be described in more detail.

The principal component of the guideway is a spanning member 1 which spans between columns 2 that rest on foundations 3. The spanning member is a shell in FIG. 3, a folded plate in FIG. 4, and an open-top box girder in FIG. 5. It contains the track structure which, in FIGS. 3 and 4, comprises ballast 4 in which ties 5 are embedded. The running rails 6 are mounted on the ties 5 utilizing conventional track hardware 7. The rail transit vehicle 8 traverses the running rails 6. The sides of the spanning member 1 are constructed to a level higher than the top of the running rails 6 in order to shield the surrounding community from train-generated noise. The inner surface of the spanning member sides is curved so as to reflect the outward propagating sound downward onto the ballast. The upper portion of the spanning member 1 is an edge beam 9 located at a level slightly above the vehicle floor 10. In some situations it may be desirable to extend the sides of the spanning member even higher. In addition to resisting longitudinal bending, the edge beam 9 serves as a lateral restraint to the vehicle in case of derailment, and also as a walkway railing.

Power is supplied to the vehicles from either a conventional power rail 11 or a catenary system 12. Service systems 13 are located on the inside face of the spanning member 1 below the edge beam 9.

Figure 3:
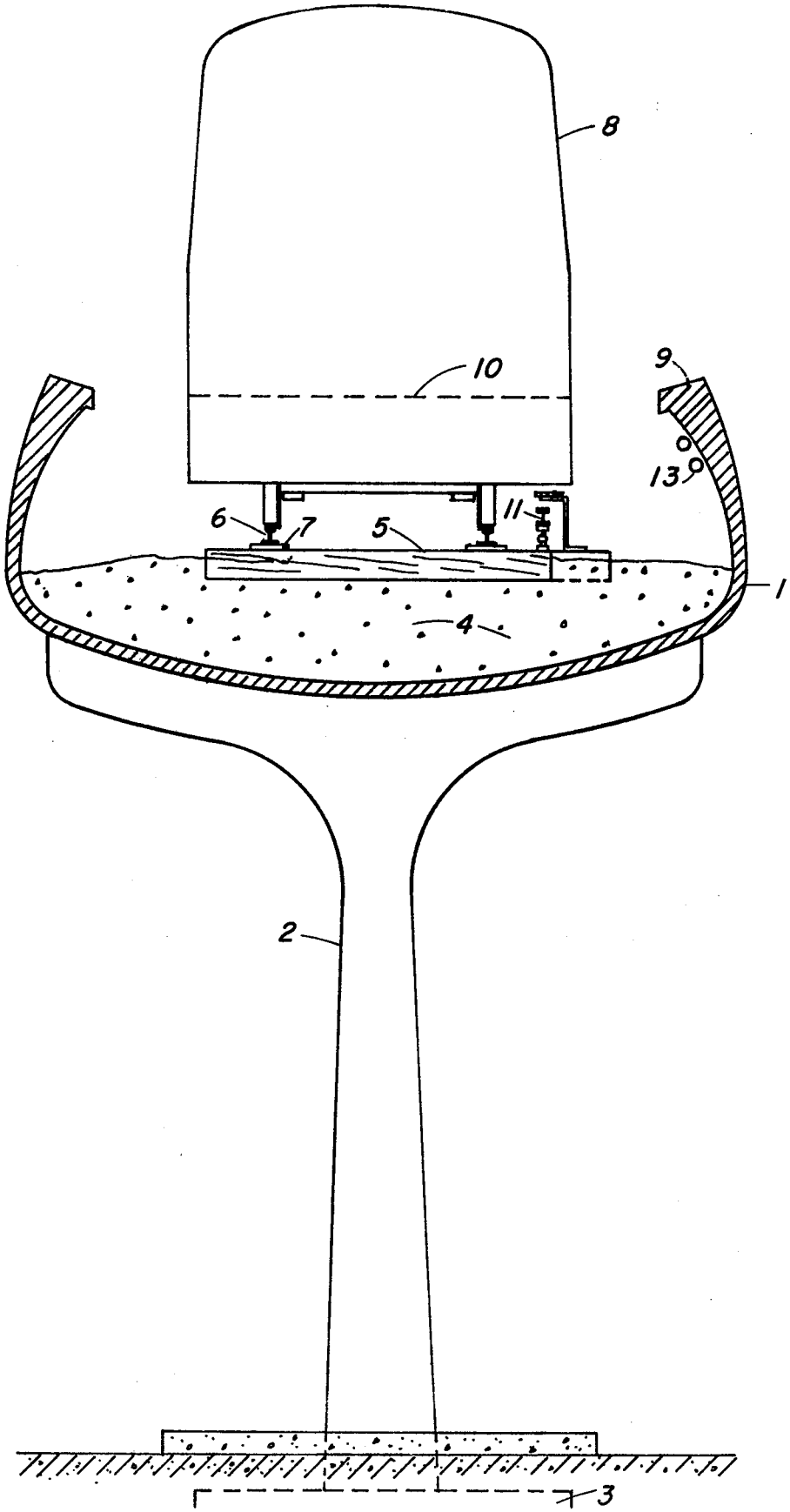
FIG. 3 is an enlarged cross-sectional view along line A—A of FIGS. 1 and 2.

The spanning member 1 may be manufactured from prestressed concrete, steel, or other materials. FIG. 3 shows a shell as the spanning member with the exterior shell surface comprised of segments of circular cylinders. However, cylinders with other than circular directrixes may be utilized as well. The shell need not be of uniform thickness, and the thickness shown in FIG. 3 is implicitly intended to include such transverse and longitudinal stiffening ribs as may be necessary. Also, deeper stiffeners or diaphragms may be required where the shell units are supported by the columns. The edge beam 9 is required as the compression flange for shell beam action. Its top width must be adequate to preclude lateral buckling. The edge beam 9 also resists the lateral forces of impacting vehicles and protects the service subsystems 13 in the event of derailment.

Figure 4:
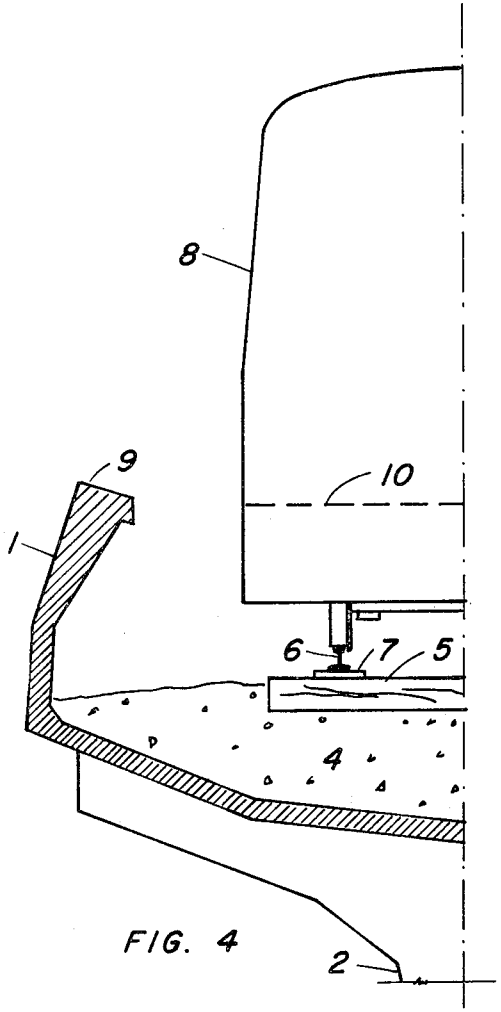
FIG. 4 is a half cross-sectional view along line A—A of FIGS. 1 and 2 with a folded plate serving as the spanning member.

The guideway shown in FIG. 4 is similar to that of FIG. 3 except that the spanning member is a folded plate. In this case the inside surface of the sidewall is composed of planes oriented so as to reflect the outward propagating sound downward onto the ballast.

Figure 5:
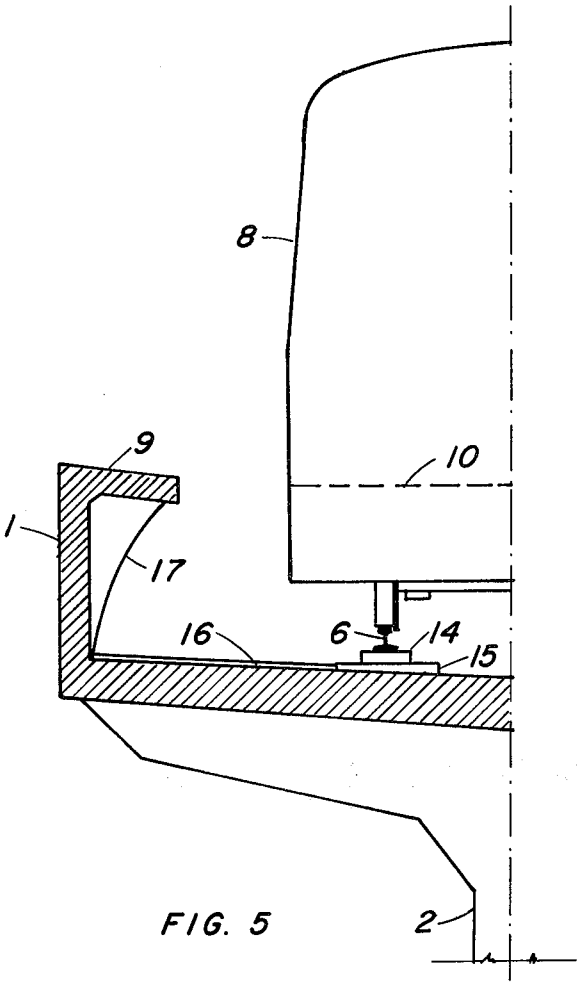
FIG. 5 is a half cross-sectional view along line A—A of FIGS. 1 and 2 with an open-top box girder serving as the spanning member.

FIG. 5 depicts a guideway in which the spanning member is an open-top box girder. In this case the conventional track is replaced by running rails 6 supported on elastomeric pads 14 which are supported, in turn, on concrete pads 15 cast atop the spanning member 1. At trackside a sound dispersing layer 16 of suitable material, for instance, elastomeric, is fastened atop the spanning member 1. The sound reflecting surface is not that of the structural member. Instead, a separate, non-structural sheet of suitable material, herein termed the curved reflecting barrier 17, is installed specifically to reflect the sound waves onto the dispersing material 16.

Figure 6:
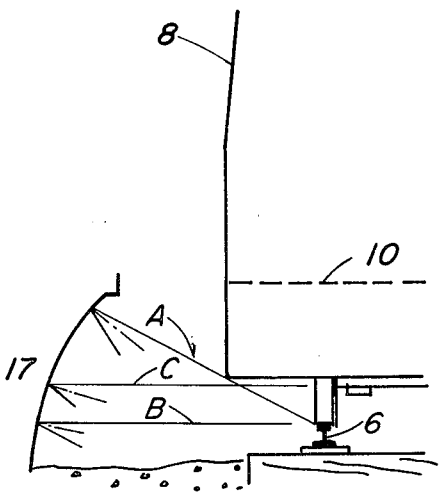
FIG. 6 is a profile of the inside shape of the reflecting surface showing the path of the sound waves.

The action of the reflecting surface, whether or not it is that of the spanning member, is illustrated in FIG. 6. The sound waves A originating at the rail head and propagating outward and upward under the vehicle strike the reflecting surface and are refracted downward onto the dispersing material. Waves B emitted at the rail head and propagating outward horizontally are affected the same way. Waves C from other underfloor sources also are deflected by the reflecting surface downward onto the dispersing surface. The shape of the reflecting surface may be of any form that will reflect the sound waves downward onto the track so as to minimize transmission to the surrounding community and to the passenger compartment of the vehicle.

Apart from structural considerations, shells, folded plates, and box girders are desirable structural subsystems for a guideway because they physically contain all the other subsystems as well as derailed vehicles. The danger of track hardware falling on personnel at ground level is eliminated because the track rests on a closed surface and the edge beam top slopes inward so that items left thereon will drop inward, not off the structure.

Aesthetically, an elevated transit guideway system appears best when it is least obtrusive, casts a minimal shadow, and has a smooth closed exposed surface. On this basis the guideway described herein is superior to those constructed heretofore. It is less obtrusive because the rails are located closer to the ground than for open deck construction, for a given underclearance. Furthermore, because of their shapes the spanning capabilities of shells, folded plates, and box girders are longer than for conventional deck girder construction for a given dimension between the top of the running rails and the underside of the structure. The appearance of the proposed guideway is also superior to conventional elevated rail transit structures when viewed from the ground because of its smooth clean surfaces.

The most important improvement of the proposed guideway is the suppression of train-generated noise, which is accomplished in two ways. Noise generated below the transit car floors which radiates laterally is impeded from propagating into the surrounding area by the upper portion of the spanning members acting as a baffle or baffles which extend above the top-of-rail level. Noise impinging on the interior of the spanning member is reflected diagonally downward onto the dispersing material at trackside and is thereby diffused.

Transmission of rail vibrations to the structure is damped by the ballasted track or elastomeric pads. Because the spanning member is a single unit of considerable mass it will not reverberate and thereby propagate noise to the atmosphere.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A noise suppressing elevated rail transit guidance system for dual rail tracks, including a spanning member, said spanning member adapted to be supported on at least one column, said spanning member including a dual track, side walls, at least one side wall including a longitudinal edge beam, said side walls extending to about the floor level of vehicles normally running on said track, said edge beam being integral to said spanning member and of sufficient thickness to longitudinally support said spanning member and normal transit ransit of rail vehicles, noise absorption means in said spanning member, said noise absorption means at least beneath said dual track and extending substantially to at least the walls of said spanning member, and said side walls including at least an inner curved configuration adapted to reflect noise from said vehicle on said tracks downward into said noise absorption means.

2. The invention of claim 1 wherein said spanning member is a shell.

3. The invention of claim 1 wherein said spanning member is a folded plate.

4. The invention of claim 1 wherein said spanning member is an open-top box girder.

5. The invention of claim 1 wherein said noise absorption means is track ballast.

6. The invention of claim 1 wherein said noise reflecting configuration is not integral to said side walls and is a separate curved inner structure within said spanning member walls.

* * * * *